US006442800B1

(12) United States Patent
Morawetz

(10) Patent No.: US 6,442,800 B1
(45) Date of Patent: Sep. 3, 2002

(54) MOTOR VEHICLE DOOR BRAKE WHICH HAS AN OPENING END STOP AND WHICH IS INTEGRATED IN A HINGE

(75) Inventor: Richard Morawetz, Wuppertal (DE)

(73) Assignee: Ed. Scharwaechter GmbH, Remscheid (DE)

( * ) Notice: Subject to any disclaimer, the term of this patent is extended or adjusted under 35 U.S.C. 154(b) by 0 days.

(21) Appl. No.: 09/673,708

(22) PCT Filed: Jan. 28, 1999

(86) PCT No.: PCT/DE99/00253

§ 371 (c)(1),
(2), (4) Date: Jan. 22, 2001

(87) PCT Pub. No.: WO99/54581

PCT Pub. Date: Oct. 28, 1999

(30) Foreign Application Priority Data

Apr. 21, 1998 (DE) ..... 198 17 739

(51) Int. Cl.[7] ..... E05C 17/64; E05D 11/08

(52) U.S. Cl. ..... 16/337; 16/335; 16/342; 16/386; 16/339; 16/296; 16/327; 16/332

(58) Field of Search ..... 16/337, 335, 342, 16/341, 374, 386, 339, 296, 273, 82, 327, 332; 296/146.11, 146.12; 49/386

(56) References Cited

U.S. PATENT DOCUMENTS

| | | | | |
|---|---|---|---|---|
| 324,444 A | * | 8/1885 | Wolf | 16/322 |
| 2,992,452 A | | 7/1961 | Schonitzer | 16/141 |
| 4,630,333 A | * | 12/1986 | Vickers | 16/338 |
| 5,867,869 A | * | 2/1999 | Garrett et al. | 16/252 |
| 5,918,347 A | * | 7/1999 | Morawetz | 16/274 |
| 6,073,308 A | * | 6/2000 | Linnenbrink et al. | 16/263 |

FOREIGN PATENT DOCUMENTS

| | | |
|---|---|---|
| DE | 4406824 A1 | 9/1995 |
| DE | 0816610 A2 | 1/1998 |

* cited by examiner

*Primary Examiner*—Chuck Y. Mah
(74) *Attorney, Agent, or Firm*—Davidson, Davidson & Kappel, LLC

(57) ABSTRACT

The invention relates to a motor vehicle door brake which has an opening end stop and which is integrated in a hinge. The hinge is comprised of two hinge halves which are interconnected in a jointed manner by means of a hinge pin. Said hinge halves can alternately engage with one of both door assembly parts, the door, or the door pillar. The hinge pin is connected to the first hinge half in a rotationally fixed manner and is accommodated in the hinge eye of the first hinge half in a rotational manner. In addition, the door brake comprises at least one engaging part which is supported against one of the hinge halves, and has at least one braking or stopping part. Said braking or stopping part is assigned to the engaging part and is supported against the other hinge half. The aim of the invention is to produce a door brake having a reduced number of individual parts and to obtain a smallest possible construction in which the application of high brake forces rise in an increasing manner over the door opening angle. To this end, the door brake is collectively comprised of at least one engaging part and of at least one braking surface. Said engaging part is radially aligned in relation to the hinge axis, is connected to one of the hinge halves in a rotationally fixed manner, and can be elastically deformed in a plane which is parallel to the hinge axis. Said braking surface is configured on the hinge pin and is limited by an end stop. The at least one braking surface which is configured on the hinge pin and which interacts with the engaging part slopes upward in the direction of the hinge axis.

14 Claims, 3 Drawing Sheets

MOTOR VEHICLE DOOR BRAKE WHICH HAS AN OPENING END STOP AND WHICH IS INTEGRATED IN A HINGE

FIELD OF INVENTION

The present invention concerns a motor-vehicle door brake which is integrated in a hinge and has an opening end stop, the hinge comprising two hinge wings which are connected together in an articulated manner by means of a hinge pin and can be fixed alternately to one of the two door assembly parts, door or door pillar, and the hinge pin being connected in a rotationally secure manner to the one hinge wing and being held rotatably in the gudgeon of the one hinge wing, and the door brake comprising at least one engagement part which is supported against one of the hinge wings, and also at least one braking or stop part which is assigned to the said engagement part and is supported against the other hinge wing.

BACKGROUND INFORMATION

For the purpose of braking and securing motor-vehicle doors in certain or random opening positions, use is conventionally made of door stops which are known and are customary in a multiplicity of embodiments. In this case, a first type of door stop which is combined structurally with the door hinge is distinguished by the use of a torsion bar spring which is bent in a C- or U-shape, is secured to the one hinge half or to a comparable part and interacts with a latching segment fastened to the other hinge half or to a comparable part, but irrespective of its particular embodiment is associated with the disadvantage that its functioning parts are basically arranged such that they are exposed and therefore can first of all be impaired in their efficiency by, albeit unintentional, coatings of paint during the painting of the bodywork, and furthermore during operation lead to contamination due to unavoidable abrasion and dirt.

All those types of door stops in which a holding part which is connected to the one door assembly part is inserted into a holder housing fastened to the other door assembly part are associated with the same disadvantages, since here too at least the holding part has to be arranged such that it is exposed and is therefore naturally subjected to the same adverse effects as the functioning parts of the so-called torsion-bar door stops.

A third known type of door stop combined structurally in particular with the door hinge is distinguished by the fact that the holding parts are arranged in an extension of the hinge axis projecting over the door hinge. Although, in door stops of this type, there is in principle the option of covering the functioning parts of the door stop by an additional component and therefore of eliminating some of the disadvantages of the abovementioned types of door stops, this necessarily results in an increased outlay in terms of production and installation. In addition, all of these door-stop embodyments which are connected to a door hinge require a considerable amount of space for fitting them in, which is not available in most cases of use.

Finally, a type of door stop integrated in a hinge is also already known, the said door stops as a whole comprising a cylinder housing which is connected in a rotationally secure manner to one of the door assembly parts, a cylinder core which is accommodated in the cylinder housing and connected in a rotationally secure manner to the other door assembly part, and also at least one engagement part which is arranged in a radially adjustable manner in the one part, cylinder housing or cylinder core. Although door stops designed in this manner and integrated in a hinge are distinguished by a design which is small in size, and are virtually completely encapsulated, they are associated with the disadvantage of a relatively high outlay in terms of production.

SUMMARY OF THE INVENTION

The present invention is based on the object of improving a door brake which can be integrated in a door hinge and a motor-vehicle door hinge which is fitted with an integrated door brake to the effect that the door brake comprises a minimum number of parts irrespective of the maximum door-opening angle, and while high braking forces which rise increasingly over the door-opening angle are applied, is, as a whole, designed such that it is as small in size as possible and also is of a closed design such that neither the painting of the vehicle bodywork nor the operation of the vehicle door or the functioning of the door brake can result in abrasion of paint or dirt or an impairment of the functioning, and that furthermore a reliable opening end stop for the door is ensured.

According to the present invention, this object is may be achieved in that the door brake as a whole comprises at least one engagement part which is arranged aligned radially with respect to the hinge axis, is connected in a rotationally secure manner to one of the hinge wings, can be deformed in a resiliently elastic manner in a plane parallel to the hinge axis and comprises at least one braking surface which is formed on the hinge pin and is bounded by an end stop, the at least one braking surface which is formed on the hinge pin and interacts with the engagement part having a rising slope in the direction of the hinge axis. This door brake is distinguished first of all by the fact that for it to be realized on a door hinge only one additional part, namely the engagement part, is required, and that furthermore very high braking forces can be applied by using the ability of the engagement part to deform in a resiliently elastic manner. Since, in the case of the door brake designed according to the present invention, the braking forces are applied and supported exclusively in the direction of the hinge axis, a door brake of this type which is based on using the ability of the engagement part to deform in a resiliently elastic manner is suitable for use in conjunction with any type of door hinge, i.e. both single-shear and double-shear door hinges. Moreover, the door brake according to the present invention makes possible a wide range of different forms of development which can be matched on the one side to the particular hinge shape or hinge type and on the other side can be configured in accordance with the required braking forces.

In a simple form of implementation which can be used in conjunction with any desired design form of a door hinge, it is provided that the at least one braking surface which interacts with the engagement part, which can be deformed in a resiliently elastic manner, is formed by the one end surface of a radial recess formed in the hinge pin, the radial recess in the hinge pin only extending over the permitted opening angle of the hinge. A motor-vehicle door brake of this type which is characterized by an exclusively axially acting design of the door-brake device can obviously also be realized in the case of a double-shear door hinge and is advantageously furthermore characterized in that the engagement part is formed by an element which is held in a rotationally secure manner and aligned radially with respect to the hinge pin on the one hinge wing and engages in the radial recess formed in the said hinge pin and also can be deformed in a resiliently elastic manner in a plane parallel to the hinge axis.

In the case of a motor-vehicle door brake of the construction according to the present invention, in order to form an opening end stop of the motor-vehicle door, it is provided that the two flank surfaces of the engagement part are inclined in the same direction and uniformly towards the hinge axis in the region of the said engagement part which interacts with the braking surface formed in the hinge pin by the one end surface of the radial recess, and that in conjunction with such a design of the flank surfaces of the engagement part the opening end stop is formed by a boundary wall, which is directed radially with respect to the hinge axis, of the radial recess, which is formed in the hinge pin.

Within the scope of a preferred embodiment of a motor-vehicle door brake according to the present invention intended primarily for use in conjunction with a single-shear door hinge, it is provided that the door brake as a whole is arranged within the gudgeon height of the hinge wing which can be pivoted with respect to the hinge pin, and the engagement part is held and supported in a pocket-like recess, which is aligned radially with respect to the hinge axis, of the pivotable hinge wing.

In order to obtain an optimum braking force with as small a construction of the motor-vehicle door brake as possible, it is expediently provided that the two end surfaces of the radial recess formed in the hinge pin are designed such that they rise in the axial direction of the hinge axis and such that they converge towards each other in the door opening direction in order to form two mutually opposite braking surfaces, and in that each of the two braking surfaces is assigned one end surface of the engagement part, the said end surface being adjustable in a resiliently elastic manner in a plane parallel to the hinge axis. With a linear and smooth-faced design of the end surfaces of the recess in the hinge pin, which end surfaces form the braking surfaces, this measure enables the obtaining of a high braking force which rises uniformly and continuously as the door-opening angle increases, without the required overall size of the door brake being changed significantly as a result.

One design of the engagement part, associated with this form of design of the braking surfaces, is distinguished by the fact that the engagement part is formed by a one-piece, essentially tongue-shaped moulded body which extends over the entire height of the radial recess in the hinge pin and which is provided with a slotted recess which is arranged centrally and is aligned in a plane running transversely to the hinge axis, so that its engagement regions interacting with the braking surfaces can be adjusted in a resiliently elastic manner. The engagement part is therefore expediently designed such that it is essentially U-shaped, the outer flank surfaces of its profiled legs forming the braking bodies which interact with the braking surfaces and as such in order to apply the required braking force being deformed or deflected in the opposite direction corresponding to the reduction in the height of the radial recess in the hinge pin, which reduction is caused by the convergingly directed rising slope of the braking surfaces.

In the interests of integrating the door brake in the hinge to as large an extent as possible, in a further development of the present invention, it is expediently also provided that the pocket-like recess in the pivotable hinge wing, which recess holds the engagement part and is aligned radially with respect to the hinge axis, is closed by means of a cover part, it being the case that a screw bolt assigned to the fastening of the cover part, said screw bolt simultaneously reaching through a hole recess in the engagement part.

In the case of a motor-vehicle door brake of the preferred embodiment, virtually completely wear-free and smooth running over the working life of the hinge and therefore of the door brake is essentially achieved by the fact that the hinge bearing arrangement and the door brake arranged therein are provided with a one-off lifetime lubrication. According to an expedient individual development, a form of designing the door hinge suitable for ensuring such a lifetime lubrication makes provision that a radially projecting collar which fits over the open side of the gudgeon is formed in conjunction with a hood-like design of the gudgeon, fitting over the hinge pin, of that hinge wing on the hinge pin which can be pivoted with respect to the hinge pin and contains the engagement part, and that the gudgeon of the pivotable hinge wing, which gudgeon fits over the hinge pin in a hood-like manner, is sealed by means of a sealing washer which is inserted between its open end side and the radially projecting collar of the hinge pin.

However, in a modified form of designing the above-described, novel type of motor-vehicle door brakes, which form is associated with obtaining non-linearly rising braking forces for a motor-vehicle door brake integrated in a door hinge, it can also be provided that the two mutually opposite braking surfaces formed by the two end surfaces of the radial recess of the hinge pin have a discontinuous rising slope starting from their end assigned to the closed position of the door and proceeding as far as their end assigned to the final opening position of the door.

Finally, an advantageous development of a door hinge provided with a motor-vehicle door brake according to the invention can also be distinguished by the fact that the rotationally secure fixing of the hinge pin on the other hinge wing is assigned a gudgeon of the other hinge wing, which gudgeon accommodates an associated longitudinal section of the hinge pin, is of essentially hood-like design and is provided with serrations, and that said rotationally secure fixing is also assigned a screw which keeps the serrations in engagement and reaches through the end wall of the hood-shaped gudgeon.

BRIEF DESCRIPTION OF THE DRAWINGS

The present invention is described in detail in the following description of examples with reference to an exemplary embodiment illustrated in the drawing, in which.

DETAILED DESCRIPTION OF THE DRAWINGS

Figure 2:
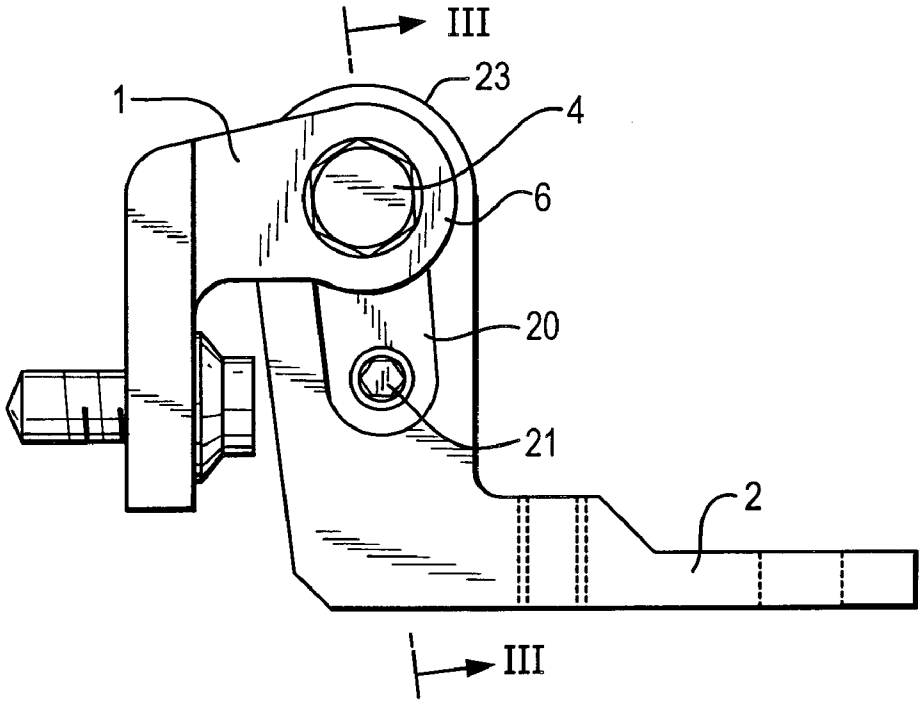
FIG. 2 shows a plan view of a hinge according to FIG. 1.
Figure 1:
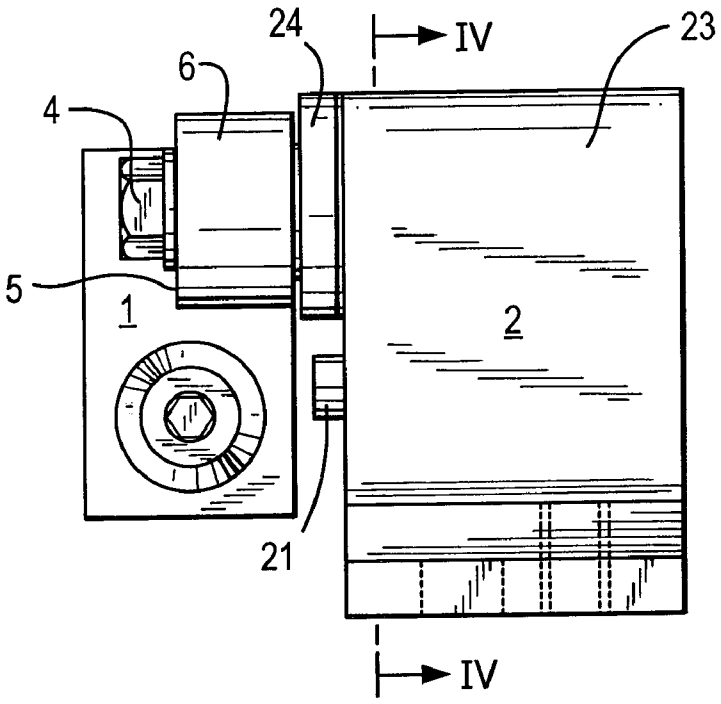
FIG. 1 shows a side view of a door hinge fitted with an integrated door brake.
Figure 5:
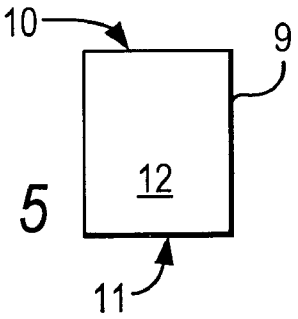
FIG. 5 shows a developed view of the plan view form of the radial recess in the hinge pin.
Figure 4:
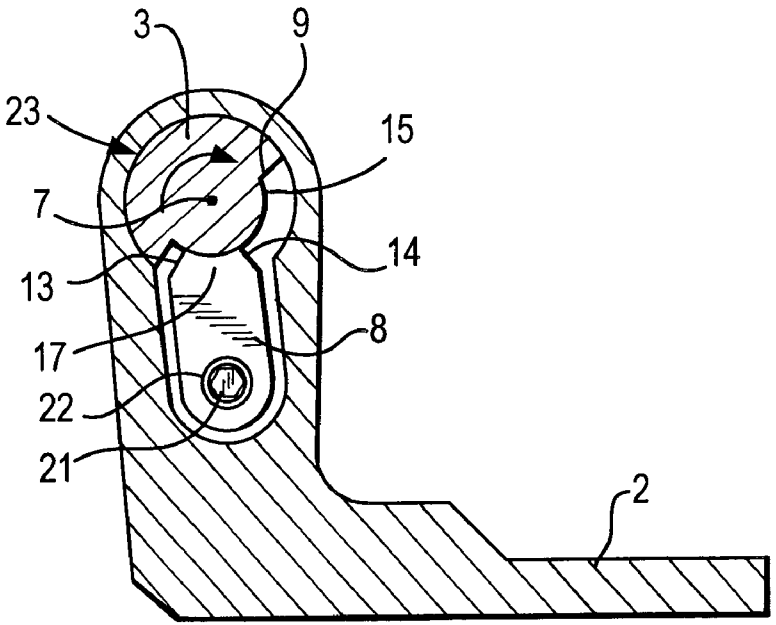
FIG. 4 shows a cross section through the door hinge along the line IV—IV in FIG. 1.
Figure 3:
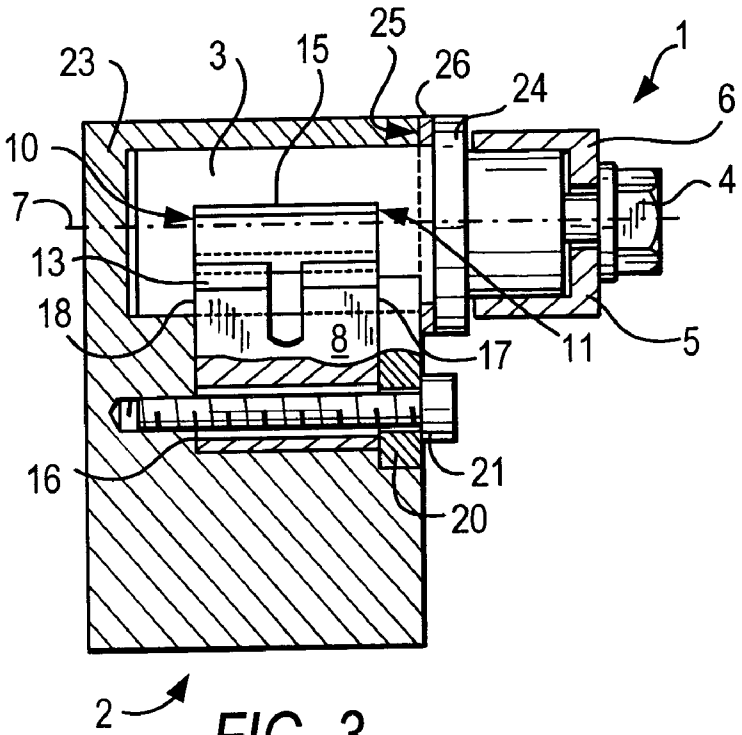
FIG. 3 shows a longitudinal section through the hinge along the line III—III in FIG. 2.

In the embodiment of a motor-vehicle door brake which is shown in the exemplary embodiment and is integrated in a door hinge, the door hinge comprises a first hinge half 1 which is to be fixed to the one door assembly part, and a second hinge half 2 which is to be fixed to the other door assembly part, and also a hinge pin 3. In this case, the hinge pin 3 is braced against the bottom surface 5 of a gudgeon 6, of overall approximately cup-like design, of the hinge half 1 by means of a screw bolt 4 reaching through the said hinge half 2. In order to connect the hinge pin 3 to the hinge half 1 in a rotationally secure manner, the gudgeon 6 is provided on the inside with serrations and the hinge pin 3 has a complementary profiling over part of its engagement length. The door brake comprises an engagement part 8 which is arranged aligned radially with respect to the hinge axis 7, is fastened in a rotationally secure manner in the hinge wing 2 and can be deformed in a resiliently elastic manner in a plane parallel to the hinge axis 7, and two braking surfaces 10 and 11 which are formed on the hinge pin 3 and are bounded by an end stop 9, the braking surfaces 10 and 11, which are formed on the hinge pin 3 and interact with the engagement part 8, being formed by the mutually opposite end surfaces of a recess 12 in the hinge pin, which recess is made radially in the said hinge pin and is preferably produced by milling out, and each having, oppositely directed, a rising slope in the direction of the hinge axis 7. The oppositely directed rising slopes of the braking surfaces 10 and 11 are designed such that they converge linearly and smoothly starting from that end of the radial recess 12 which is assigned to the closing position of the door and proceeding to that end of the radial recess 12 assigned to the maximum opening angle of the door, as can be seen in particular from the illustration of FIG. 5. In the embodiment shown of a motor-vehicle door brake, the opening end stop of the motor-vehicle door is configured in such a manner that the two flank surfaces 13 and 14 of the engagement part 8 are inclined in the same direction and uniformly towards the hinge axis 7. In conjunction with the flank surface 14, the opening end stop 9 determines the maximum permitted door-opening angle, and is formed by a boundary wall 15, directed radially with respect to the hinge axis 7, of the radial recess 12, which is formed in the hinge pin 3. In the embodiment shown, the engagement part 8 is designed as a simple molded part, in particular a simple material blank, and is accommodated and supported in a pocket-like recess 16, aligned radially with respect to the hinge axis 7, of the pivotable hinge wing 2. The engagement part 8 has two engagement regions 17 and 18 which are each assigned to one of the two braking surfaces 10 and 11 and can be adjusted in a resiliently elastic manner in a plane parallel to the hinge axis 7. In the embodiment shown, the engagement part 8 is formed by a one-piece, essentially tongue-shaped moulded body which extends over the entire height of the radial recess 12 in the hinge pin 3 and is provided with a slotted recess 19, which is arranged centrally and is aligned in a plane running transversely to the hinge axis 7, so that the engagement regions 17 and 18 of said engagement part, which interact with the braking surfaces 10 and 11, can be adjusted in a resiliently elastic manner. The pocket-like recess 16 of the pivotable hinge wing 2, which recess holds the engagement part and is aligned radially with respect to the hinge axis 7, is closed by means of a cover part 20. A screw bolt 21 which is assigned to the fastening of the cover part 20 on the end side of the hinge wing 2 at the same time reaches through a hole recess 22 in the engagement part 8. The gudgeon 23 of the hinge wing 2 which can be pivoted with respect to the hinge pin 3 is of hood-like design and engages over the hinge pin 3. Furthermore, a radially projecting collar 24 is formed on the hinge pin 3, the said collar engaging between the two gudgeons 6 and 23 of the two hinge wings 1 and 2 and at which the open side 25 of the gudgeon 23 of the pivotable hinge wing 2, which gudgeon engages over the hinge pin 3 in a hood-like manner, is sealed by means of a sealing washer 26 inserted between its open end side 25 and the radially projecting collar 24 of the hinge pin 3. The hinge bearing arrangement and the door brake arranged therein are furthermore provided with a one-off lifetime lubrication which cannot be seen in detail from the drawing.

Figure 6:
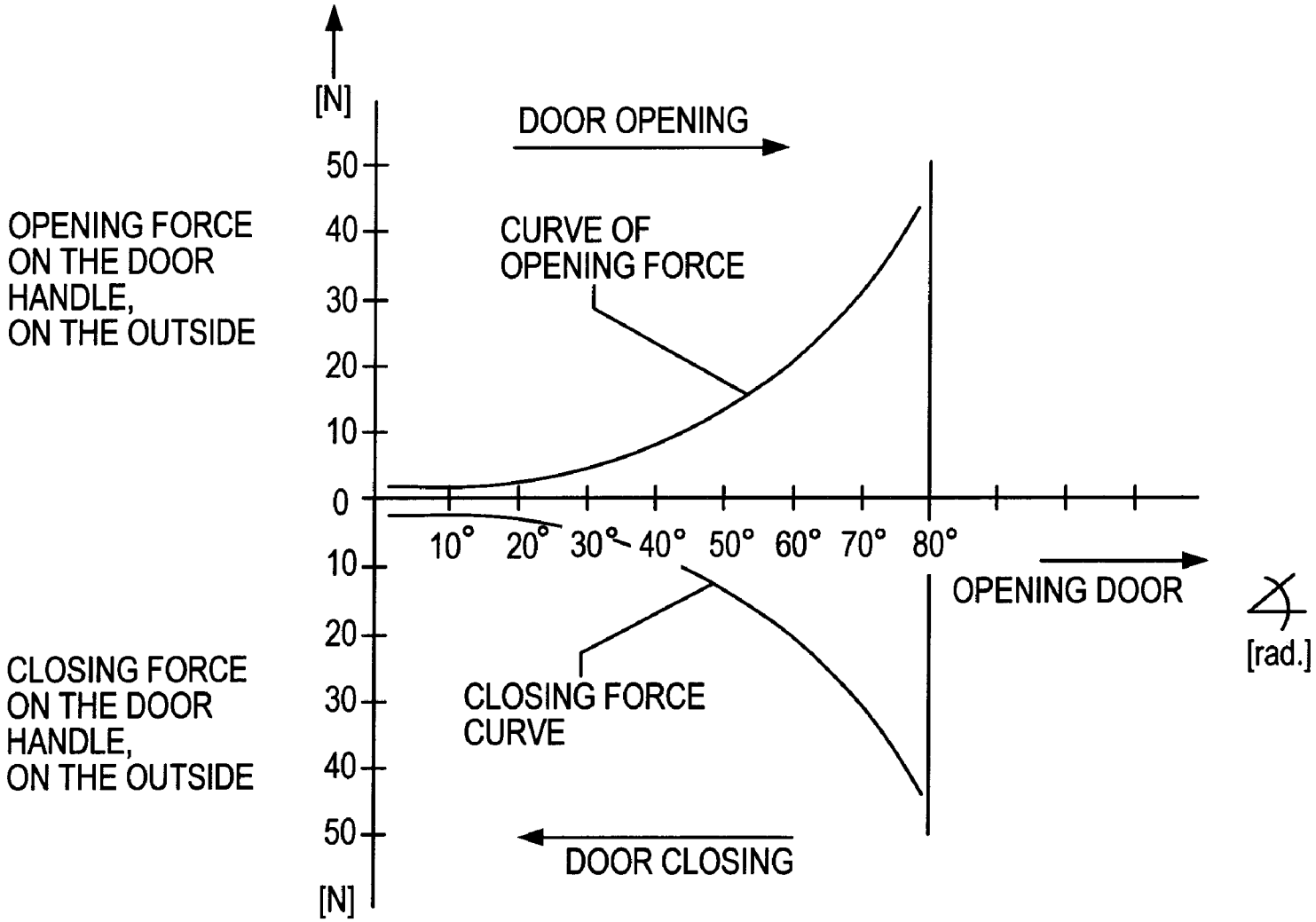
FIG. 6 shows a diagrammatic illustration of the profile of the braking forces over the door-opening angle.

From the diagrammatic illustration, shown in FIG. 6, of the profile of the braking forces from the above-described embodiment of a door brake, which are applied over the door-opening angle, it can be seen in particular that even when there is a linear and continuously and uniformly rising configuration of the rising slope of the two braking surfaces of the door brake, a superproportional rise in the braking forces in the door-opening direction as the door-opening angle increases can be achieved. Furthermore, the diagrammatic illustration shows that the braking forces applied by the door brake initially fall very rapidly as the door is being closed from a maximum value assigned to the final opening position of the door, which increases the ease of operating the door.

What is claimed is:

1. A motor vehicle door brake which is integrated in a hinge and has an opening end stop, said hinge comprising a first hinge wing, a second hinge wing and a hinge pin, wherein said first hinge wing is able to be fixed on one door assembly part selected from a door and a door pillar, and wherein said second hinge wing being able to be fixed on the other of said door and said door pillar, said hinge pin connecting said first and second hinge wings in an articulated manner and defining a hinge axis, wherein said hinge pin is connected to the first hinge wing in a rotationally secure manner and wherein said hinge pin is rotatably held in a gudgeon of the second hinge wing, wherein said hinge pin is provided with at least one braking surface, wherein said at least one braking surface is bounded by an end stop and has a rising slope in direction of the hinge axis, said door brake comprising an engagement part which is supported against and connected in a rotationally secure manner to said second hinge wing, wherein said engagement part is aligned radially with respect to the hinge axis and is able to be deformed in a resiliently elastic manner in a plane parallel to the hinge axis, and wherein said braking surface interacts with said engagement part.

2. The motor vehicle door brake according to claim 1, wherein the hinge pin has a radial recess, said radial recess only extending over a permitted opening angle of the hinge, wherein said at least one braking surface is formed by one out of two end surfaces of said radial recess.

3. The motor vehicle door brake according to claim 2, wherein said engagement part is formed by an element and engages in said radial recess formed in the hinge pin.

4. The motor vehicle door brake according to claim 3, wherein the second hinge wing has a pocket-like recess, the pocket-like recess being aligned radially with respect to the hinge axis, said pocket-like recess accommodating and supporting said engagement part, wherein the door brake as a whole is arranged within the gudgeon height of the second hinge wing.

5. The motor vehicle door brake according to claim 4, wherein said engagement part which is accommodated in said pocket-like recess has a hole recess, and further comprising a screwbolt reaching through said hole recess, and a cover part, said cover part closing said pocket-like recess, wherein said screwbolt is assigned to the fastening of said cover part, said screwbolt simultaneously reaching through said hole recess.

6. The motor vehicle door brake according to claim 3, wherein said two end surfaces of the radial recess formed in the hinge pin are designed such that they rise in the axial direction of said hinge axis and such that they converge towards each other in the door opening direction in order to form two mutually opposite braking surfaces, and wherein each of the two braking surfaces is assigned to one out of two end surfaces of the engagement part, said two end surfaces of the engagement part being adjustable in a resiliently elastic manner in a plane parallel to the hinge axis.

7. The motor vehicle door brake according to claim 6, further comprising a discontinuous rising slope of each of said mutually opposite braking surfaces, said discontinuous rising slope starting from the respective end of said mutually opposite braking surfaces assigned to the closed position of the door and proceeding as far as their respective end assigned to the opening end position of the door.

8. The motor vehicle door brake according to claim 2, further comprising a boundary wall of said radial recess formed in the hinge pin, said boundary wall being directed radially with respect to the hinge axis, wherein said opening end stop of the hinge is formed by said boundary wall.

9. The motor vehicle door brake according to claim 2, further comprising a one-piece, essentially tongue-shaped molded body which extends over the entire height of the radial recess formed in the hinge pin, a slotted recess provided in said one-piece, essentially tongue-shaped molded body, said slotted recess being arranged centrally and being aligned transversely to the hinge axis, wherein said one-piece, essentially tongue shaped molded body is forming said engagement part and it also being the case, that the engagement regions of said engagement part can be adjusted in a resiliently elastic manner using said slotted recess.

10. The motor vehicle door brake according to claim 1, further comprising two flank surfaces of the engagement part, said surfaces being inclined in the same direction and uniformly towards said hinge axis in a region of the engagement part which interacts with said at least one braking surface.

11. The motor vehicle door brake according to claim 1, further comprising a hood-like design of said gudgeon of said second hinge wing, said gudgeon fitting over the hinge pin using said hood-like design, and a radially projecting collar which is formed at the hinge pin, wherein the radially projecting collar fits over the open end side of said gudgeon of the second hinge wing.

12. The motor vehicle door brake according to claim 11, further comprising a sealing washer which is inserted between said radially projecting collar and the open end side of said gudgeon of the second hinge wing.

13. The motor vehicle door brake according to claim 11, further comprising a one-off lifetime lubrication, said lubrication being provided to said gudgeon of the second hinge wing.

14. The motor vehicle door brake according to claim 1, further comprising a gudgeon of said first hinge wing, said gudgeon having a hood-like design and holding an associated longitudinal section of the hinge pin, serrations provided each at said gudgeon of the first hinge wing and at the associated longitudinal section of the hinge pin, a screw, wherein said hinge pin and said first hinge wing are connected in a rotationally secure manner by means of said serrations, and wherein said screw reaches through an end wall of said gudgeon of said first hinge wing and keeps said serrations in engagement.

* * * * *